US005768804A

United States Patent [19]

Goggia et al.

[11] Patent Number: 5,768,804

[45] Date of Patent: Jun. 23, 1998

[54] CLOSURE DEVICE FOR SPORTS FOOTWEAR, HAVING AN EXTENDABLE RACK ELEMENT

[75] Inventors: Giuseppe Goggia; Marco Breda, both of Treviso, Italy

[73] Assignee: Tecnica Spa, Treviso, Italy

[21] Appl. No.: 716,777

[22] Filed: Sep. 24, 1996

[30] Foreign Application Priority Data

Oct. 4, 1995 [IT] Italy ..... TV950051 U

[51] Int. Cl.[6] ..... A43B 5/04; A43C 11/00

[52] U.S. Cl. ..... 36/50.5; 24/685 K

[58] Field of Search ..... 36/50.1, 505; 24/685 K, 24/695 K, 705 K, 715 K

[56] References Cited

U.S. PATENT DOCUMENTS

| | | | |
|---|---|---|---|
| 3,956,796 | 5/1976 | Guolo | 36/50.5 X |
| 4,395,801 | 8/1983 | Gabrielli | 36/50.5 X |
| 5,592,722 | 1/1997 | Foscaro et al. | 36/50.5 X |

FOREIGN PATENT DOCUMENTS

| | | | |
|---|---|---|---|
| 1136406 | 11/1982 | Canada | 36/50.5 |
| 0 401 202 | 12/1990 | European Pat. Off. . | |
| 0 705 545 | 4/1996 | European Pat. Off. . | |
| 2644565 | 4/1977 | Germany | 24/205 K |

*Primary Examiner*—B. Dayoan

*Attorney, Agent, or Firm*—Griffin, Butler Whisenhunt & Szipl

[57] ABSTRACT

Closure device for sports footwear, especially for a ski boot. On one edge of a front opening of the boot, a series of levers is provided with their free end having a hook and tightening pin, while a corresponding series of rack elements 10 is provided on the opposing edge of the front opening. A groove 14 in each of the rack elements can receive the hook of a lever. Provided at the free end of at least one rack element 10 is an extendible and retractable additional hooking element 26 which can receive the hooking pin of the opposing closure lever. The extendible and retractable additional hooking element 26, when in its operative state, projects outside the free end of the rack 10 which is therefore extendible.

10 Claims, 2 Drawing Sheets

CLOSURE DEVICE FOR SPORTS FOOTWEAR, HAVING AN EXTENDABLE RACK ELEMENT

The present innovation relates to a closure device for sports footwear and especially for ski boots having an adjustable rack element.

BACKGROUND OF THE INVENTION

More especially, the device according to the invention is used to tighten, relative to one another, the opposing edges of a front opening of the boot which enables the foot to be inserted therein. Once this tightening operation has been completed, the device locks the foot inside the boot.

The known devices of this type comprise, on one of the edges of the front opening, a series of locking levers, each of which is provided, at its free end, with at least one hooking and tightening pin which can be engaged in a groove or seat of a rack element provided on the opposing edge of the front opening of the boot.

The hooking engagement of the pins of the various tightening levers inside the grooves or seats of the racks permits the closure of the front opening of the boot which is thus put on and secured to the user's foot in a stable manner.

It is known that the above-mentioned hooking engagement of the pins of the tightening levers in the grooves of the rack elements naturally has to be effected with considerable force in order to lock the foot stably inside the boot.

The above operation is not without disadvantages, which result, above all, from the fact that it is often difficult to reach the relevant groove of the racks with the pin of one or more tightening levers, even in cases where the groove is the one nearest the end of the lever, that is to say, the first to be affected by the hooking operation.

These difficulties are principally the result of the substantial rigidity of the material forming the boot, which makes it difficult to move the opposed edges of its front opening towards one another for the engagement of the lever with the rack element, especially as regards the first tightening lever. The above disadvantage is then further aggravated in cases where the leg portion which is placed inside the boot, corresponding substantially to the user's calf, is of a size incompatible with being accommodated in the boot without force, thus further hindering the necessary operations mentioned briefly above for closing the boot.

In order to facilitate the hooking of the pins of the various levers to the corresponding racks, it is known to produce a closure device of the type in question in which at least one lever is provided, at its end, with an additional pin arranged internally in the area of said end, that is to say, contained within the lever. It is therefore easy to hook the lever to the rack using the above-mentioned additional internal pin. Once a lever of a closure device has been hooked to the corresponding rack, and once this device has been closed, the edges of the boot are moved sufficiently close to one another to enable the levers of all the other closure devices to be hooked to the respective racks. It should, however, be noted that, despite the introduction of the additional internal pin mentioned above, there are still difficulties in hooking the levers to the corresponding racks, for the same reasons as those explained above.

A closure device for sports footwear, and especially for a ski boot, which avoids the disadvantages of traditional devices has now been devised and forms the subject-matter of the present innovation. One of the principal aims of the present innovation is therefore to provide a closure device of the above type by means of which the hooking operation is greatly facilitated and which helps the user to close the boot.

Another not inconsiderable aim of the present innovation is to provide a closure device for sports footwear which, in addition to offering the above advantage, is of an extremely simple and economical construction and therefore does not affect, substantially the overall cost of the boot. Another aim of the present innovation is to provide a closure device which is easy to use and does not involve the user in complex operations, bearing in mind the fact that the user's special clothing would make these operations extremely onerous and tiring.

SUMMARY OF THE INVENTION

The closure device for sports footwear and especially for a ski boot according to the present invention comprises, on one edge of a front opening of the boot, a series of levers, each of which is provided at its free end with at least one hooking and tightening pin, while the opposing edge of the front opening is provided with a corresponding series of rack elements, a groove or seat of each which can receive in hooking and tightening engagement a hook of a lever of the series of levers, the said device being characterised in that a extendible and retractable additional hooking element which can receive the hooking pin of the opposing closure lever is provided at the free end of at least one rack element, the extendible and retractable additional hooking element being movable with respect to the rack and, in its operative state, projecting outwards from the free end of the rack which is therefore extendable.

Therefore, in order to facilitate the hooking of the lever to the rack, it is sufficient to use the additional hooking element by engaging it with the hooking pin provided at the end of the closure lever.

The benefits deriving from the provision of this additional hooking element are considerable and can be appreciated by the user above all because a reduced force is required to move the opposing edges of the front opening of the boot towards one another in order to close it by hooking the additional element to the opposing closure lever.

The additional hooking element is preferably movable relative to the rack element so that it can assume a first position, or operative position, in which it projects from the rack and a second position, or rest position, in which it is retracted into the rack element.

The skier can then decide from case to case whether the use of the additional element is necessary, and can thus pull it out of the rack element, or, if it is not necessary to use it, he can leave it retracted in the rack.

The features and advantages of the closure device according to the present innovation will be appreciated more clearly from the following detailed description of non-limiting embodiments given with reference to the appended drawings.

DESCRIPTION OF PREFERRED EMBODIMENTS

Figures 1, 2, 3:
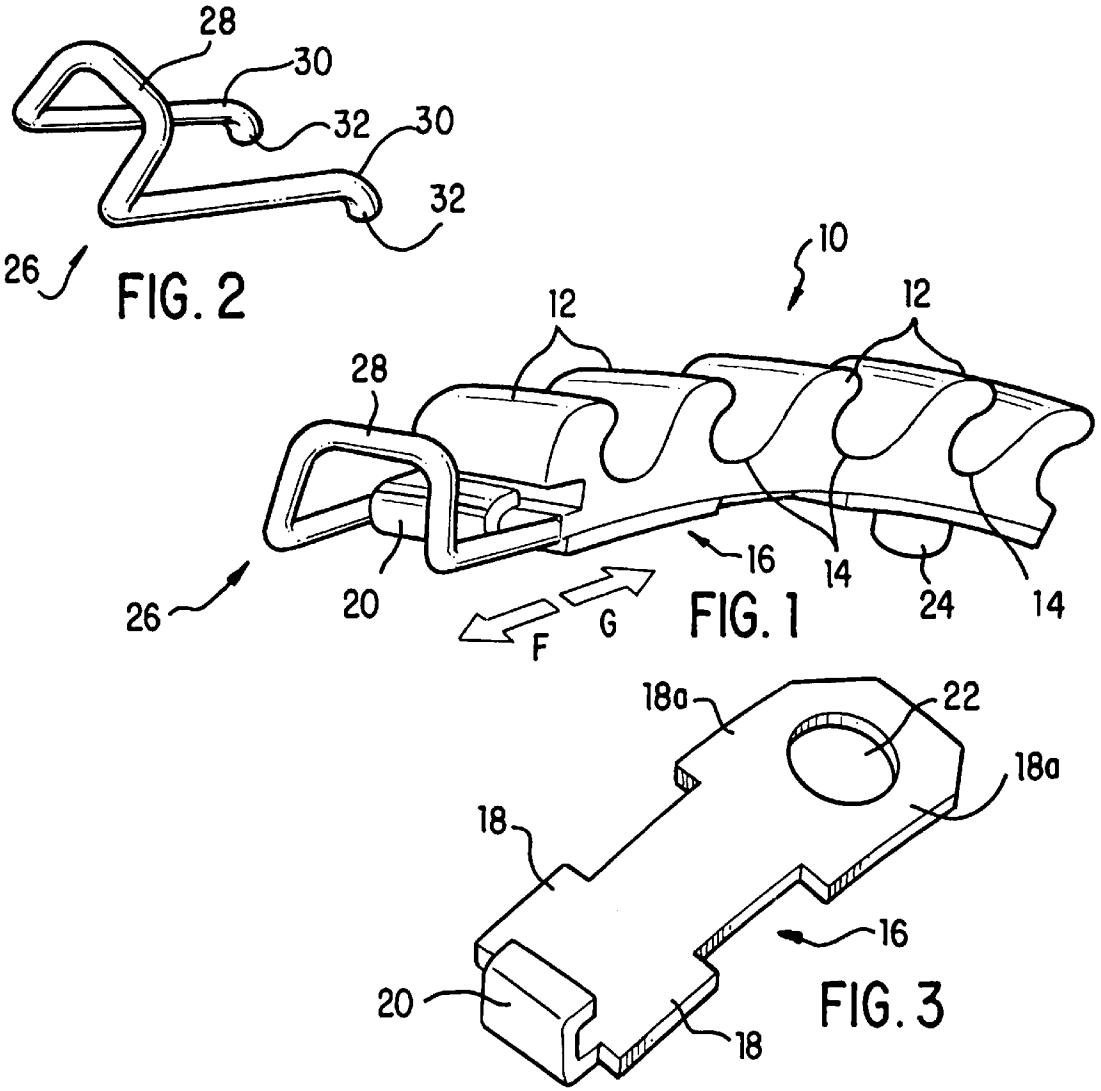
FIG. 1 is a diagrammatic perspective view of a rack element of the closure device for sports footwear according to the present innovation.
FIG. 2 is a diagrammatic perspective view showing the single extendible and retractable additional hooking element with which the rack element is provided.
FIG. 3 is a diagrammatic perspective view of a shaped plate element which is secured to the bottom of the rack element and which permits the movement of the additional hooking element between the operative position and the rest position.
Figure 6:
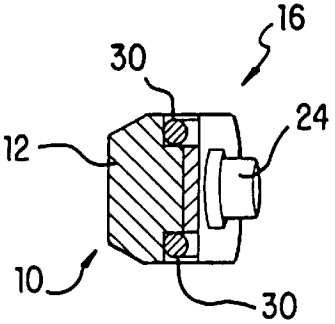
FIG. 6 is a view of the rack element along section VI—VI of FIG. 4.
Figure 7:
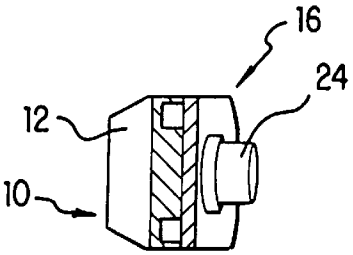
FIG. 7 is a view of the rack element along section VII—VII of FIG. 5.

Referring first of all to FIG. 1, the rack element of the closure device according to the present invention, generally indicated 10, is provided in customary manner with a predetermined number of shaped teeth 12 which delimit between them grooves or seats 14 which can receive by hooking engagement the hooking and tightening pin of a hooking lever is known per se for closing and opening the front of the boot. The boot is likewise not shown because it is known per se, i.e., the so-called "front entry" ski boots being well known.

A shaped plate, which is generally indicated 16 and which is shown in more detail in FIG. 3, is fitted in in any known manner below the rack element 10.

This Figure shows that the plate 16 is of a substantially rectangular shape and is of a length and width of substantially the same order as the rack element so that it can be applied to the latter. The plate 16 is provided at its ends with side fins or projections 18, 18*a* which are coplanar with the plane of the plate 16 and permit the guided sliding of an additional hooking element, which will be discussed hereinafter.

The plate 16 is provided, at its end where the fins 18 are arranged, with a transverse lug 20 which is substantially C-shaped in cross-section. The lug 20 extends from the end of the rack 10, and its concave portion faces the rack element 10 when the plate 16 is applied thereto. The function of the lug 20 is to prevent any sliding of the rack 10 when the latter is under a load and when it is hooked to a locking lever. This is effected especially by the engagement of the end edge of the lug 20 with the end tooth of the rack 10.

As can be seen especially in FIG. 1, and more specifically and clearly in FIGS. 4 and 5, the width of the transverse lug 20 is substantially equal to that of the body of the plate 16 in order to enable the additional hooking element described hereinafter to be applied and moved relative to the plate 16. It will also be appreciated that the application and the movement of the above-mentioned additional hooking element relative to the plate 16 is rendered possible in conjunction with the provision of the fins 18 on which portions of the additional hooking element slide as will be seen more clearly hereinafter.

As shown in FIG. 3, but as will also be appreciated from FIGS. 1 and 4 to 7, the body of the plate 16 has, at its end opposite that where the transverse lug 20 is provided, a through-hole 22, the function of which is to act as a reference check for the correct positioning of the plate 16 relative to the rack 10. For that purpose, the rack 10 has, on its rear face, a corresponding projection 24 which, when the plate 16 is applied to the rack 10, is introduced into the hole 22, thus providing for the correct mutual positioning of the plate 16 and the rack 10. The projection 24 also acts as a means of locking the plate 16 to the rack 10 and, to that end, once it has been introduced into the hole 22, it is applied to the relevant portion of the boot, for example by means of a riveting operation.

Referring now especially to FIG. 2, but also bearing in mind the representations of FIGS. 1 and 4 to 7, the additional hooking element mentioned above will be described hereinafter.

This element is advantageously a extendible and retractable hooking element comparable in configuration and function to the teeth of the rack 10.

The additional hooking element is generally indicated 26 and is formed by preferably, a metal profiled member which is expediently shaped as indicated hereinafter.

Its operative portion 28, that is to say, the part which is engaged by the pin of the opposing closure lever, is substantially in the shape of an inverted U which extends in two substantially rectilinear and mutually parallel arms or branches 30 which are of the same length as one another. The longitudinal axis of the arms 30 forms, with the plane of the operative portion 28, an angle of slightly less than 90°, which substantially reproduces the slightly inclined configuration of the teeth 12 of the rack 10.

The ends 32 of the arms 30 are bent relative to the longitudinal axis of the latter and substantially form a right-angle therewith. In particular, these ends are orientated relative to the arms 30 in the opposite direction to the operative portion 28.

Figure 4:
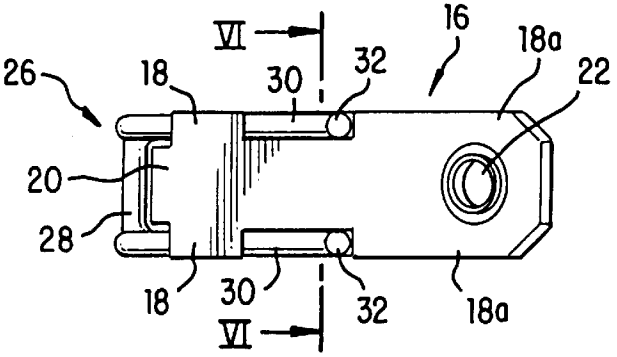
FIG. 4 is a diagrammatic bottom view of the rack element with the additional hooking element in the retracted state.
Figure 5:
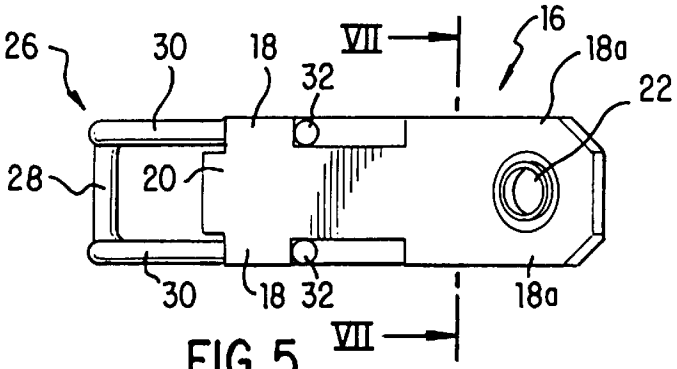
FIG. 5 is a view similar to FIG. 4 with the additional hooking element in the extended position.

The additional hooking element 26 is expediently dimensioned in such a manner as to simulate the configuration of a tooth 12 of the rack 10 when it is in the extended position shown in FIGS. 1 and 5 and not to project excessively from the rack 10 when it has been retracted into the same, that is to say, in the state shown in FIG. 4.

For that purpose, the height and width of its operative portion 28 arc substantially the same as those of the teeth 12 while, at the same time, the distance between the arms 30 is calculated in such a manner that they can slide on the fins 18 of the plate 16, supported transversely by the lower side edges of the rack 10. In this respect it will be noted that the rack 10 has two parallel longitudinal cavities which permit the introduction and the sliding of the arms 30 therein. At the same time, the ends 32 of the arms 30 are movable in the recesses of the plate 16 which are delimited by the opposing faces of the fins 18 and 18*a*, as shown especially in FIGS. 4 and 5. To be more precise, the opposing faces of the fins 18 and 18*a* constitute stops for the ends 32 of the arms 30 against which these ends stop either in the retracted state (FIG. 4) or in the extended state (FIG. 5) of the additional hooking element 26. It will be readily appreciated that the movement of the additional element 26 takes place in two opposite directions, and in particular in the direction indicated by the arrow F in FIG. 1 in order to be extended from the rack 10, and in the direction indicated by the arrow G of the same Figure in order to be retracted into the same.

The advantages deriving from the use of the closure device according to the present innovation are clear from the above and, moreover, the principal ones have already been indicated above. Finally, it will be appreciated that variations and/or modifications which are equivalent in design and structure may be made to the closure device according to the present innovation without thereby departing from its scope of protection.

We claim:

1. In a closure device for sports footwear, comprising, a series of levers adapted for mounting on an edge of a front opening of the footwear, each of which is provided at a free end with at least one hooking and tightening pin, a series of rack elements adapted for mounting on an opposing edge of a front opening of footwear a groove of each which can receive in hooking and tightening engagement the pin of the lever of the series of levers, the improvement wherein an extendible and retractable additional hooking element (26) which can receive the pin of an opposing lever is provided at a free end of at least one of the rack elements (10), the extendible and retractable additional hooking element (26) being movable with respect to the rack element (10) and, in an operative state, projects outwardly from the free end of the rack element (10).

2. Closure device according to claim 1, wherein a shaped plate (16) is secured below the rack (10) aid delimits, with two longitudinal cavities formed in the rack (10), a seat for guided sliding of the extendible and retractable additional booking element (26) between the operative state in which it projects from the rack (10) and a rest position in which it is retracted inside the free end of the rack (10).

3. Closure device according to claim 1, wherein the extendible and retractable additional hooking element (26) has an operative portion (28) which can be moved outside the rack (10), which portion is extended in at least one portion which can slide in the seat delimited by the plate (16) and by at least one cavity of the rack (10).

4. Closure device according to claim 3, wherein the operative portion (28) of the extendible and retractable additional hooking element (26) is substantially in the shape of an inverted U which extends in two substantially rectilinear and mutually parallel arms (30) which are of the same length as one another.

5. Closure device according to claim 4, wherein a longitudinal axis of the arms (30) forms, with the plane of the operative portion (28), an angle of slightly less than 90° in order substantially to reproduce the slightly inclined configuration of the teeth (12) of the rack (10).

6. Closure device according to claim 5, wherein a ends (32) of the arms (30) of the extendible and retractable additional hooking element (26) are bent relative to the longitudinal axis of said arms, substantially forming a right-angle therewith, and being orientated, relative to the arms (30), in an opposite direction to the operative portion (28).

7. Closure device according to claim 6, wherein the sliding movement of the arms (30) of the extendible and retractable additional hooking element (26) is limited by stops with which the ends (32) of the arms (30) engage.

8. Closure device according to claim 7, wherein the stops for the sliding movement of the arms (30) are formed by opposing faces of lateral fins **(18, 18*a*) provided on the plate (16)**.

9. Closure device according to claim 2, wherein plate (16) has at least one hole (22) which can receive a projection (24) of the rack (10), the projection (24) then being secured to the hole (22).

10. Closure device according to claim 2, wherein the plate (16) is provided, at a side near the additional hooking element (26), with a transverse lug (20) which extends towards the rack (10) when the plate (16) is applied thereto, the lug (20) engaging, by means of an end edge, with an end tooth of the rack (10).

* * * * *